US012298089B2

(12) United States Patent
Gotterbarm et al.

(10) Patent No.: US 12,298,089 B2
(45) Date of Patent: May 13, 2025

(54) METAL HEAT EXCHANGER TUBE

(71) Applicant: WIELAND-WERKE AG, Ulm (DE)

(72) Inventors: Achim Gotterbarm, Dornstadt (DE); Manfred Knab, Dornstadt (DE); Ronald Lutz, Blaubeuren (DE)

(73) Assignee: WIELAND-WERKE AG, Ulm (DE)

( * ) Notice: Subject to any disclaimer, the term of this patent is extended or adjusted under 35 U.S.C. 154(b) by 198 days.

(21) Appl. No.: 18/245,405

(22) PCT Filed: Oct. 7, 2021

(86) PCT No.: PCT/EP2021/000121
§ 371 (c)(1),
(2) Date: Mar. 15, 2023

(87) PCT Pub. No.: WO2022/089773
PCT Pub. Date: May 5, 2022

(65) Prior Publication Data

US 2023/0341193 A1 Oct. 26, 2023

(30) Foreign Application Priority Data

Oct. 31, 2020 (DE) ..... 10 2020 006 684.4

(51) Int. Cl.
*F28F 1/42* (2006.01)
*F28F 1/36* (2006.01)
*F28F 13/18* (2006.01)

(52) U.S. Cl.
CPC ..... *F28F 1/36* (2013.01); *F28F 1/422* (2013.01); *F28F 13/187* (2013.01); *F28F 2215/10* (2013.01)

(58) Field of Classification Search
CPC .... F28F 13/187; F28F 1/36; F28F 1/42; F28F 1/422; F28F 2215/10
See application file for complete search history.

(56) References Cited

U.S. PATENT DOCUMENTS 4,313,248 A 2/1982 Fujikake
4,796,693 A 1/1989 Kastner et al.
(Continued)

FOREIGN PATENT DOCUMENTS

DE 19757526 C1 4/1999
DE 102008013929 B3 4/2009
(Continued)

OTHER PUBLICATIONS

International Search Report with English Translation issued in corresponding International Application No. PCT/EP2021/000121 date of mailing Jan. 13, 2022 (5 pages).
(Continued)

*Primary Examiner* — Eric S Ruppert
(74) *Attorney, Agent, or Firm* — FLYNN THIEL, P.C.

(57) ABSTRACT

A metal heat exchanger tube having integral fins formed on the tube outside and having a fin foot, fin flanks and a fin tip. The fin foot protrudes radially from the tube wall, and a channel is formed between the fins. Spaced-apart additional structures are arranged in a channel base and divide the channel between the fins into segments. The additional structures reduce the throughflow area in the channel and limit fluid flow during operation. First additional structures are radial projections emerging from the channel base and are delimited radially by an end surface located between the channel base and the fin tip. Material protrusions in the form of second additional structures lie at the location of the projections. The material protrusions are arranged between the end surface and the fin tip and lie laterally on the fin flank, and extend further axially and radially than circumferentially.

10 Claims, 3 Drawing Sheets

(56) References Cited

U.S. PATENT DOCUMENTS

| | | | | |
|---|---|---|---|---|
| 5,186,252 | A | 2/1993 | Nishizawa et al. | |
| 5,597,039 | A | 1/1997 | Rieger | |
| 5,669,441 | A | 9/1997 | Spencer | |
| 5,697,430 | A | 12/1997 | Thors et al. | |
| 6,067,832 | A | 5/2000 | Brand et al. | |
| 6,786,072 | B2 | 9/2004 | Beutler et al. | |
| 7,254,964 | B2 | 8/2007 | Thors et al. | |
| 8,281,850 | B2 | 10/2012 | Beutler | |
| 8,550,152 | B2 | 10/2013 | Beutler et al. | |
| 11,073,343 | B2 | 7/2021 | Gotterbarm et al. | |
| 2003/0024121 | A1* | 2/2003 | Beutler | F28F 1/422 29/890.03 |
| 2007/0034361 | A1 | 2/2007 | Lu et al. | |
| 2009/0229807 | A1* | 9/2009 | Beutler | F28F 1/36 165/182 |
| 2010/0288480 | A1 | 11/2010 | Beutler et al. | |
| 2015/0241140 | A1* | 8/2015 | Beutler | F28F 1/422 165/104.21 |
| 2015/0247681 | A1* | 9/2015 | Beutler | F28F 1/422 165/179 |

FOREIGN PATENT DOCUMENTS

| | | | |
|---|---|---|---|
| DE | 102014002829 | A1 | 8/2015 |
| EP | 0108364 | B1 | 5/1984 |
| EP | 0222100 | B1 | 5/1987 |
| EP | 1223400 | B1 | 7/2002 |
| EP | 2253922 | A2 | 11/2010 |
| EP | 2917674 | B1 | 9/2015 |
| EP | 3111153 | B1 | 1/2017 |
| JP | 6323778 | A | 11/1994 |
| WO | 2022089772 | A1 | 5/2022 |

OTHER PUBLICATIONS

Written Opinion of International Searching Authority issued in corresponding International Application No. PCT/EP2021/000121 dated Jan. 13, 2022 (5 pages).

German Office Action issued in corresponding German Application No. 10 2020 006 684.4 date of mailing May 7, 2021 (6 pages).

* cited by examiner

METAL HEAT EXCHANGER TUBE

TECHNICAL FIELD

The invention relates to a metal heat exchanger tube.

BACKGROUND AND SUMMARY

Evaporation occurs in numerous sectors of refrigeration and air-conditioning engineering and in process and power engineering. Use is frequently made of tubular heat exchangers in which liquids evaporate from pure substances or mixtures on the outside of the tube and, in the process, cool a brine or water on the inside of the tube.

By making the heat transfer on the outside and inside of the tube more intensive, the size of the evaporators can be greatly reduced. As such, the production costs of such apparatuses decrease. In addition, the required volume of refrigerants is reduced, which is important in view of the fact that the chlorine-free safety refrigerants which are predominantly used meanwhile may form a not insubstantial portion of the overall equipment costs. In addition, the high-power tubes customary nowadays are already approximately four times more efficient than smooth tubes of the same diameters.

The highest performance commercially available finned tubes for flooded evaporators have a fin structure on the outside of the tube with a fin density of 55 to 60 fins per inch (U.S. Pat. Nos. 5,669,441 A; 5,697,430 A; DE 197 57 526 C1). This corresponds to a fin pitch of approx. 0.45 to 0.40 mm. Furthermore, it is known that evaporation structures of improved performance can be produced with the fin pitch remaining the same on the outside of the tube by additional structural elements being introduced in the region of the groove base between the fins.

It is proposed in EP 1 223 400 B1 to produce undercut secondary grooves on the groove base between the fins, said secondary grooves extending continuously along the primary groove. The cross section of said secondary grooves can remain constant or can be varied at regular intervals.

Further examples of structures on the groove base can be found in EP 0 222 100 B1, U.S. Pat. No. 7,254,964 B2 or U.S. Pat. No. 5,186,252 A. A common feature of said structures is that the structural elements do not have an undercut shape on the groove base. These are either indentations introduced into the groove base or projections in the lower region of the channel. Higher projections are explicitly ruled out in the prior art since it appears to be of concern that the fluid flow in the channel is disadvantageously obstructed for heat exchange.

A further approach having higher structures emerging from the groove base is disclosed in EP 3 111 153 B1. The structures are projections in the channel that cause segmentation. By means of segmentation between two fins, the channel is repeatedly interrupted in the peripheral direction and therefore migration of the arising bubbles and of the heat exchange fluid in the channel is at least reduced or entirely prevented. An exchange of liquid and vapor along the channel is increasingly less or even no longer assisted by the respective additional structure.

One aspect of the invention is to develop a heat exchanger tube with improved performance for evaporating liquids on the outside of the tube.

The invention includes a metal heat exchanger tube, including integral fins which are formed on the outside of the tube and have a fin foot, fin flanks and a fin tip, wherein the fin foot protrudes radially from the tube wall, and a channel with a channel base, in which channel spaced-apart additional structures are arranged, is formed between the fins. The additional structures divide the channel between the fins into segments. The additional structures reduce the through-flow cross-sectional area in the channel between two fins locally and thereby at least limit a fluid flow in the channel during operation. First additional structures are radially outwardly directed projections which emerge from the channel base and are each delimited in the radial direction by an end surface located between the channel base and the fin tip, as a result of which a radial extent of the projections is defined. Material protrusions in the form of second additional structures are arranged lying radially outward at the location of the projections, the material protrusions being formed from material of the fin flanks. The material protrusions are each arranged in the radial direction between an end surface and the fin tip such that the material protrusions are formed lying laterally on the fin flank via the channel base of the channel around the radial extent of the projections. The material protrusions extend further in the axial and radial directions than in the circumferential direction.

These metal heat exchanger tubes serve in particular for evaporating liquids from pure substances or mixtures on the outside of the tube.

Efficient tubes of this type can be produced on the basis of integrally rolled finned tubes by means of roll disks. Integrally rolled finned tubes are understood as meaning finned tubes in which the fins have been formed from the wall material of a smooth tube. Typical integral fins formed on the outside of the tube are, for example, spirally encircling and have a fin foot, fin flanks and a fin tip, wherein the fin foot protrudes substantially radially from the tube wall. The number of the fins is established by counting consecutive bulges in the axial direction of a tube. The structures according to one aspect of the invention can be produced by a sharp-edged toothed roll disk which forms both wall material at the channel base and material on the fin flank in the axial and radial directions.

Various methods with which the channels located between adjacent fins are closed in such a manner that connections between channel and environment remain in the form of pores or slits are known. In particular, such substantially closed channels are produced by bending or folding over the fins, by splitting and upsetting the fins or by notching and upsetting the fins.

One aspect of the invention is based here on the consideration that, in order to increase the transfer of heat during evaporation, the fin intermediate space is segmented by additional structures. In this regard, local overheating is generated in the intermediate spaces, and the process of nucleate boiling is intensified. The formation of bubbles then takes place primarily within the segments and begins at nucleation sites. At said nucleation sites, first of all small gas or vapor bubbles form. When the growing bubble has reached a certain size, it detaches itself from the surface. Over the course of the bubble detachment, the remaining cavity in the segment is flooded again with liquid and the cycle begins again. The surface can be configured in such a manner that, when the bubble detaches, a small bubble remains behind which then serves as a nucleation site for a new bubble formation cycle.

In addition to the formation of bubbles within the segments, further material protrusions in the form of second additional structures are located, according to one aspect of the inventive solution, in the region of the first additional structures in the form of radially outwardly directed projections. The material protrusions are arranged laterally on the fin flank and extend substantially in the axial and radial directions. From the production process by means of rolls, the material protrusions are formed from material of the fin flanks and preferably sit directly on the projections in a manner lying radially outward. In the structures formed by the material protrusions, the fluid flow of liquid heat exchanger fluid into the adjacent segments, from the side, as it were, is assisted. Such a fluid guide therefore makes a contribution to the formation of bubbles in the segment. The projections can extend between the respective fin foot of adjacent fins in the axial direction over the entire channel base or only over part of the channel base. They constitute, as it were, a barrier which runs between two fins from the channel base, extends radially outward and at least partially closes the channel in the circumferential direction.

In other words, material protrusions according to one aspect of the invention placed onto a preferably solid projection of the channel base structure are formed from material of the fin flank in the form of second additional structures and each forms a continuous transition substantially in the radial direction to the two lateral surfaces of the projection located below them. They consequently constitute a fluid guide structure which guides liquid fluid from the side, as it were, into the segments. An end surface, arranged radially on the outside, of the projections can extend over the entire channel width. At the location of said material protrusions arranged on a projection, liquid fluid can be exchanged between adjacent segments and can also pass from one segment into an adjacent segment. The projections with the material protrusions placed thereon consequently constitute a barrier to the passage of fluid.

In this case, the material protrusions can also have a smaller extent in the axial direction than the extent of the projections arranged below them. Owing to the size, shape and orientation of the material protrusions, the wetting behavior of the heat exchanger fluid is primarily the cause of an increase in the fluid flow. The contour line of the material protrusions extending substantially in the axial and radial directions can also be curved or irregular.

According to one aspect of the invention, by means of this type of segmentation of the channel between two fins, said channel is interrupted time and again in the peripheral direction and thus at least reduces or entirely prevents the migration of the arising bubbles in the channel. Exchange of liquid and vapor along the channel is assisted by the respective additional structure to an increasingly lesser degree to even not at all.

One particular advantage of the invention is that the exchange of liquid and vapor takes place in a manner controlled in a locally specific way and the flooding of the bubble nucleation site in the segment takes place locally and in particular from the side because of the material protrusions. Overall, by means of a targeted choice of the segmentation of the channel, the evaporator tube structures can be expediently optimized depending on the use parameters, and therefore an increase in the transfer of heat is achieved. Since the temperature of the fin foot is higher in the region of the groove base than at the fin tip, structural elements for intensifying the formation of bubbles in the groove base are also particularly effective.

In addition, it is also advantageous for the additional structures to reduce the throughflow cross-sectional area in the channel between two fins locally by at least 80%. Overall, by means of an increasing separation of individual channel sections in the segmenting of the channel, the evaporator tube structures can be further optimized, depending on the use parameters, in order further to increase the transfer of heat.

In an advantageous embodiment of the invention, the projections and the material protrusions can reduce the throughflow cross-sectional area in the channel between two fins locally by at least 308. The segments are thereby sufficiently delimited locally for a passage of fluid.

Advantageously, the projections and the material protrusions can reduce the throughflow cross-sectional area in the channel between two fins locally by 40 to 708. The channel section located between two segments forms a substantial barrier in terms of fluid with respect to adjacent channel sections.

In a preferred refinement of the invention, the channel can be closed radially outward except for individual local openings. The fins here can have a substantially T-shaped or I-shaped cross section, as a result of which the channel between the fins is closed except for pores as local openings. The vapor bubbles arising during the evaporation process can escape through said openings. The fin tips are deformed by methods which can be gathered from the prior art.

In this context, the fin tips can also be folded over in the axial direction or even to a certain extent can be formed in the direction toward the channel base. Consequently, the channel may also be tapered by the desired amount from below and from the side and/or from above from a combination of a plurality of complementary structural elements or entirely closed. The channel is always subdivided into discrete segments between the fins.

By combining the segments according to one aspect of the invention with a channel which is closed except for pores or slits, a structure is obtained which has very high efficiency for the evaporation of liquids over a very wide range of operating conditions. In particular, the coefficient of heat transfer of the structure achieves a consistently high level in the event of a variation of the heat flow density or the driving temperature difference.

In an advantageous refinement of the invention, there can be at least one local opening per segment. This minimum requirement also ensures that gas bubbles arising in a channel segment during the evaporation process can escape to the outside. The local openings are designed in size and shape in such a manner that even liquid medium can pass therethrough and flow into the channel section. So that the evaporation process can be maintained at a local opening, the same quantities of liquid and vapor consequently have to be transported through the opening in mutually opposed directions. Liquids which readily wet the tube material are customarily used. A liquid of this type can penetrate the channels through each opening in the outer tube surface, even counter to a positive pressure, because of the capillary effect.

In addition, the quotient of the number of local openings to the number of segments can be 1:1 to 6:1. Furthermore preferably, said quotient can be 1:1 to 3:1. The channels located between the fins are substantially closed by material of the upper fin regions, wherein the resulting cavities in the channel segments are connected by openings to the surrounding space. Said openings may also be configured as pores which can be formed in the same size or else in two or more size classes. At a ratio at which a plurality of local openings are formed on a segment, pores with two size classes may be particularly suitable. For example, a large opening follows each small opening along the channels in accordance with a regular recurring scheme. This structure produces a directed flow in the channels. Liquid is preferably drawn in through the small pores with the assistance of the capillary pressure and wets the channel walls, as a result of which thin films are produced. The vapor accumulates in the center of the channel and escapes at locations having the lowest capillary pressure. At the same time, the large pores have to be dimensioned in such a manner that the vapor can escape sufficiently rapidly and the channels do not dry out in the process. The size and frequency of the vapor pores in relation to the smaller liquid pores should then be coordinated with one another.

In a preferred embodiment of the invention, the projections in the form of first additional structures can be formed at least from material of the channel base between two integrally encircling fins. In this regard, an integrally bonded connection is maintained for a good heat exchange from the tube wall into the respective structural elements. In addition, a projection can also additionally consist of material of the fin flank. The segmentation of the channel from a homogeneous material of the channel base is particularly favorable for the evaporation process.

In a particularly preferred embodiment, the projections in the form of first additional structures can have a height of between 0.15 and 1 mm. This dimensioning of the additional structures is particularly readily coordinated with the high-performance finned tubes and is expressed by the fact that the structural sizes of the outer structures preferably lie in the submillimeter to millimeter range.

In an advantageous manner, the projections can have asymmetric shapes. The asymmetry of the structures appears here in a section plane running perpendicularly to the tube longitudinal axis. Asymmetric shapes can make an additional contribution to the evaporation process, in particular if a relatively large surface is formed. The asymmetry can be formed both in the case of additional structures on the channel base and also at the fin tip.

In a preferred embodiment of the invention, the projections can have a trapezoidal cross section in a section plane running perpendicularly to the tube longitudinal axis. Trapezoidal cross sections in conjunction with integrally rolled finned tube structures are technologically readily controllable structural elements. Slight manufacturing-induced asymmetries in the otherwise parallel main sides of a trapezoid may occur here.

BRIEF DESCRIPTION OF THE DRAWINGS

In an advantageous manner, opposite material protrusions may be formed at the location of the projections in the direction of the tube longitudinal axis. The projections together with the opposite material protrusions consequently constitute the barrier for the passage of fluid.

Exemplary embodiments of the invention are explained in more detail with reference to the schematic drawings, in which.

Mutually corresponding parts are provided with the same reference signs in all of the figures.

DETAILED DESCRIPTION

Figure 1:
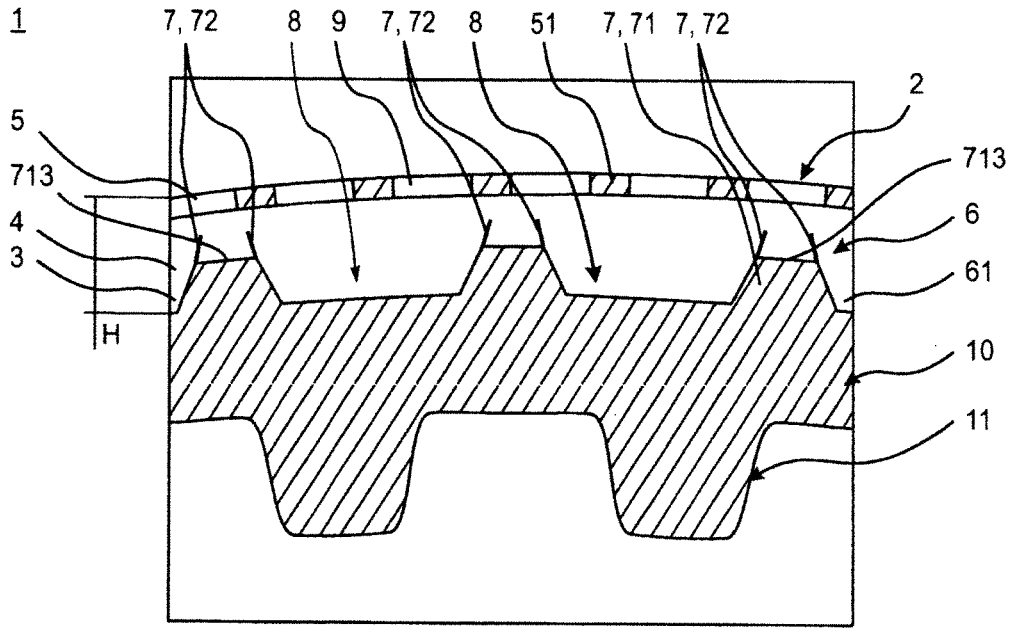
FIG. 1 shows schematically a partial view of a cross section of a heat exchanger tube with segments subdivided by additional structures.

FIG. 1 shows schematically a partial view of a cross section of a heat exchanger tube 1 according to the invention with segments 8 subdivided by additional structures 7. The integrally rolled heat exchanger tube 1 has helically encircling fins 2 on the outside of the tube, between which a primary groove is formed as the channel 6. The fins 2 extend continuously without interruption along a helix line on the outside of the tube. The fin foot 3 protrudes substantially radially from the tube wall 10. On the finished heat exchanger tube 1, the fin height H is measured, starting from the lowest point of the channel base 61, from the fin foot 3 beyond the fin flank 4 to the fin tip 5 of the completely formed finned tube.

A heat exchanger tube 1 is proposed in which an additional structure 7 in the form of projections 71 directed radially outward is arranged in the region of the channel base 61, which projections are each delimited in the radial direction by an end surface 713 located between the channel base 61 and the fin tip 5. Said projections 71 are referred to as first additional structures and are formed from the channel base 61 from material of the tube wall 10. The projections 71 are arranged at preferably regular intervals in the channel base 61 and extend transversely to the course of the channel from a fin foot 3 of a fin 2 at least partially in the direction of or completely to the next fin foot lying thereabove (not illustrated in the figure plane). Material protrusions 72 lying radially outward are arranged in the form of a second additional structure 7 at the location of a projection 71, said material protrusions being formed from material of the fin flanks 4. The material protrusions 72 are each arranged in the radial direction between an end surface 713 and the fin tip 5 such that the material protrusions 72 are formed lying laterally on the fin flank 4 via the channel base 61 of the channel 6 about the radial extent of the projections 71. The material protrusions 72 extend further in the axial and radial directions than in the circumferential direction. In this manner, the primary groove as channel 6 is at least partially tapered at regular intervals. The resulting segment 8 promotes formation of bubble nuclei in conjunction with the material protrusions 72 as guiding structures for the fluid flow in a particular manner. The direct exchange of liquid and vapor between the individual segments 8 is at least reduced.

In addition to the formation of the projections 71 on the channel base 61 with the material protrusions 72 lying radially on the outside, the fin tips 5 as the distal region of the fins 2 are expediently deformed in such a manner that they partially close the channel 6 in the radial direction with an axially folded-over fin tip 51. The connection between the channel 6 and the environment is configured in the form of pores 9 as local openings so that vapor bubbles can escape from the channel 6. The fin tips 5 are deformed by rolling methods which can be gathered from the prior art. The primary grooves 6 thereby constitute undercut grooves. By means of the combination of the projections 71 and material protrusions 72 in the form of additional structures 7, a segment 8 is obtained in the form of a hollow space which is furthermore distinguished in that it has very high efficiency for the evaporation of liquids over a very wide range of operating conditions. The liquid evaporates within the segment 8 assisted by material protrusions 72 as additional fluid guiding structures. The resulting vapor emerges from the channel 6 at the local openings 9, through which liquid fluid also flows. Readily wettable tube surfaces may also be an aid for the flowing-in of the fluid.

The solution according to one aspect of the invention relates to structured tubes in which the coefficient of heat transfer is increased on the outside of the tube. In order not to shift the main portion of the heat throughput resistance to the inside, the coefficient of heat transfer can be additionally intensified on the inside by means of a suitable internal structuring 11. The heat exchanger tubes 1 for tubular heat exchangers customarily have at least one structured region and smooth end pieces and possibly smooth intermediate pieces. The smooth end pieces and/or intermediate pieces bound the structured regions. So that the heat exchanger tube 1 can be easily installed in the tubular heat exchanger, the outer diameter of the structured regions should not be larger than the outer diameter of the smooth end and intermediate pieces.

Figure 2:
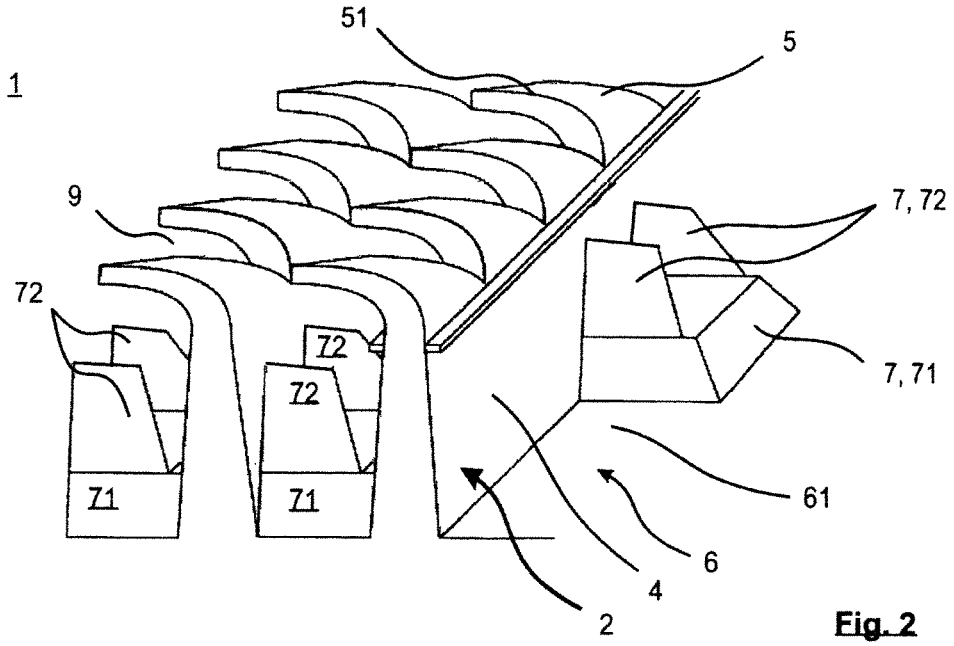
FIG. 2 shows schematically an oblique view of a part of the outer structure of a heat exchanger tube with folded-over fin tips.

FIG. 2 shows schematically an oblique view of part of the outer structure of a heat exchanger tube 1 with folded-over fin tips 51. For better illustration, only the structural elements of the outer structure that are most important for comprehension are illustrated. In addition to the formation of the projections 71 at the channel base 61 with the material protrusions 72 lying radially on the outside, the fin tips 5 in turn as a distal region of the fins 2 are deformed in such a manner that they partially close the channel 6 in the radial direction with an axially folded-over fin tip 51. The connection between the channel 6 and the surroundings is configured in the form of local openings 9 for vapor bubbles to escape from the channel 6 and liquid fluid to flow into the channel 6. The primary grooves 6 in this way in turn constitute undercut grooves. The axially folded-over fin tip 51 is formed from the fin 2 and thus extends over the channel 6 in the axial direction. With the additional structures 7, the throughflow cross-sectional area in the channel 6 between two fins 2 is particularly effectively reduced locally in order thereby to limit the fluid flow in the channel 6 during operation.

Figure 3:
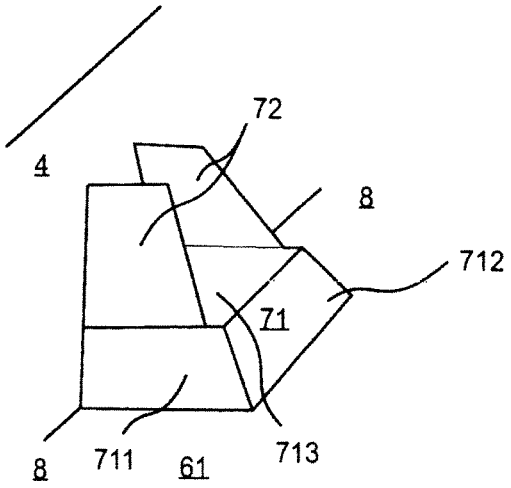
FIG. 3 shows schematically a detailed view of material protrusions at the location of a projection.

FIG. 3 shows schematically a detailed view of material protrusions 72 at the location of a projection 71. The material protrusions 72 placed radially onto a preferably solid projection 71 of the channel basic structure are produced from material of the fin flank 4 by a toothed roll disk which forms both wall material on the channel base 61 and material on the fin flank 4. Although projections 71 and material protrusions 72 are therefore formed from different regions of the tube wall, the material protrusions 72 can substantially form a transition, which is continuous in the radial direction, to the two lateral surfaces 711 of the projection 71 located below them. In this case, the projection 71 runs only in part of the channel base 61 and ends in the axial tube direction with a front surface 712. The material protrusions 72 are formed in the manner of partitions and extend approximately radially and in the direction of the tube longitudinal axis A and, for example, are formed in said axial direction approximately as far as the channel center. In this connection, the end surface 713 of the projection 71 can also extend further in the direction of the tube longitudinal axis A or even over the entire channel width between opposite fins. Starting in this region, the fluid flow can be controlled more precisely and can contribute to bubble formation in the two segments 8 that are adjacent in the peripheral direction. The projections 71 with the material protrusions 72 placed thereon consequently also constitute a barrier for the passage of fluid.

As is likewise apparent from FIG. 3, the axial extent of the material protrusions 72 is somewhat shorter than the axial extent of the projection 71 located under them. In this regard, an opening is produced with respect to the tube longitudinal axis A for the liquid heat exchanger fluid which is more easily guided from the side into the adjacent segments 8 to assist the formation of bubbles.

Figure 4:
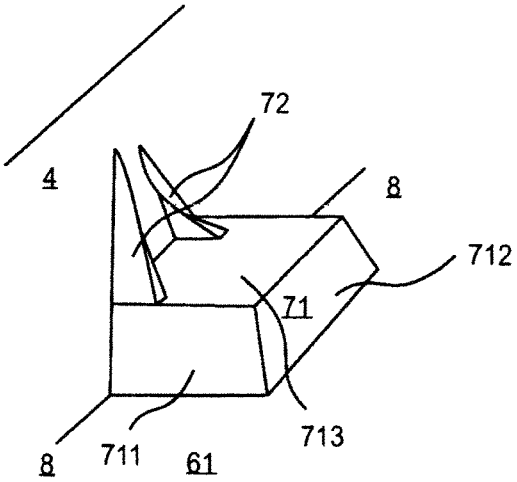
FIG. 4 shows schematically a detailed view of a further embodiment of material protrusions at the location of a projection.

FIG. 4 shows schematically a detailed view of a further embodiment of material protrusions 72 at the location of a projection 71. The material protrusions 72 which are placed radially onto a projection 71 of the channel basic structure are produced from material of the fin flank 4 by a toothed roll disk which forms both wall material on the channel base 61 and material on the fin flank 4. The contour line of the material protrusions extending substantially in the axial and radial directions is also curved or irregular. In this embodiment, the material protrusions 72 have a changing extent in the axial direction. In other words, as viewed outward in the radial direction, a continuous transition into the fin flank 4 is realized. Overall, the surfaces of the material protrusions 72 are also somewhat inherently curved. These shapes are certain variations of otherwise flat surfaces which are particularly favorable with regard to the surface properties and the wetting behavior of the liquid heat exchanger fluid. Such structures guide the liquid heat exchanger fluid in a particularly preferred manner from the side into the adjacent segments 8 to assist the formation of bubbles.

Figure 5:
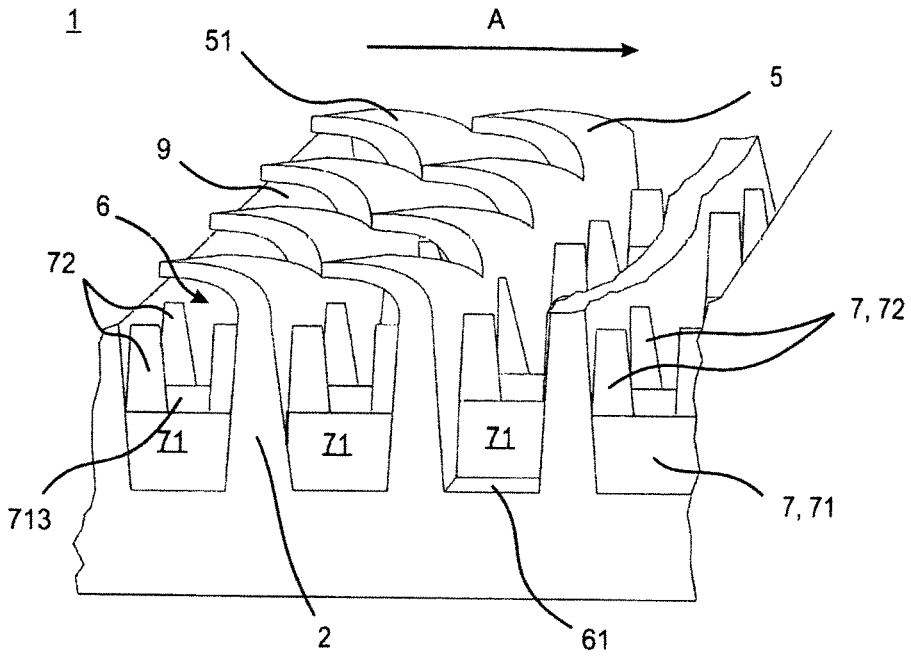
FIG. 5 shows schematically an oblique view of a part of the outer structure of a heat exchanger tube with opposite material protrusions at the location of a projection.

FIG. 5 shows schematically an oblique view of part of the outer structure of a heat exchanger tube 1 with opposite material protrusions 72 at the location of a projection 71. For better illustration, only the structural elements of the outer structure that are most important for comprehension are illustrated. In addition to the formation of the projections 71 on the channel base 61 with the material protrusions 72 lying radially on the outside, the fin tips 5 in turn as a distal region of the fins 2 are deformed in such a manner that they partially close the channel 6 in the radial direction with an axially folded-over fin tip 51. The connection between the channel 6 and the surroundings is configured as local openings 9 for vapor bubbles to escape from the channel 6 and for liquid fluid to flow into the channel 6. With the projections 71 and the material protrusions 72 in the form of additional structures 7, the throughflow cross-sectional area in the channel 6 between two fins 2 is particularly effectively reduced locally in order thereby to limit the fluid flow in the channel 6 during operation.

The projections 71 extend in this case over the entire channel width between adjacent fins 2 in the direction of the tube longitudinal axis A. Opposite material protrusions 72 are formed lying radially outward at the location of the projections 71. The projections 71 with the material protrusions 72 placed thereon consequently constitute a barrier for the passage of fluid.

The invention claimed is:

1. A metal heat exchanger tube, comprising:

a tube wall having an outside;

integral fins formed on the outside of the tube wall, each of the integral fins having a fin foot, fin flanks and a fin tip, the fin foot of each integral fin protruding radially from the tube wall;

a channel having a channel base, the channel being formed between the integral fins; and additional structures arranged in the channel in spaced-apart relation and dividing the channel into segments, the additional structures reducing a throughflow cross-sectional area of the channel between the integral fins locally to at least limit a fluid flow in the channel during operation, first ones of the additional structures comprising radially outwardly directed projections emerging from the channel base and each of the first ones of the additional structures being delimited in a radial direction by an end surface located between the channel base and the fin tip such that the end surface defines a radial extent of the respective projection, second ones of the additional structures comprising material protrusions arranged radially outward at locations of the respective projections, the material protrusions being formed from a material of the fin flanks, the material protrusions each being arranged in the radial direction between one of the end surfaces and the fin tip, the material protrusions being formed so as to lie laterally on the fin flank and around a radial extent of the respective projections, and the material protrusions extending further in axial and radial directions than in a circumferential direction.

2. The heat exchanger tube as claimed in claim 1, wherein the projections and the material protrusions reduce the throughflow cross-sectional area in the channel locally by at least 30%.

3. The heat exchanger tube as claimed in claim 1, wherein the projections and the material protrusions reduce the throughflow cross-sectional area in the channel locally by at least 40 to 70%.

4. The heat exchanger tube as claimed in claim 1, wherein the channel is closed radially outward except at individual local openings.

5. The heat exchanger tube as claimed in claim 1, wherein the individual local openings include at least one local opening per each of the segments.

6. The heat exchanger tube as claimed in claim 1, wherein the projections are formed at least from a material of the channel base.

7. The heat exchanger tube as claimed in claim 6, wherein the projections have a height of between 0.15 and 1 mm.

8. The heat exchanger tube as claimed in claim 1, wherein the projections have asymmetric shapes.

9. The heat exchanger tube as claimed in claim 1, wherein the projections have a trapezoidal cross section in a section plane running perpendicularly to a tube longitudinal axis.

10. The heat exchanger tube as claimed in claim 1, wherein opposite ones of the material protrusions are formed at the locations of the projections in a direction of a tube longitudinal axis.

* * * * *